United States Patent [19]

Brachert et al.

[11] Patent Number: 4,627,352

[45] Date of Patent: Dec. 9, 1986

[54] SINGLE- OR MULTIPLE-BASE POWDER CHARGES FOR PROPELLANTS AND PROCESS FOR THEIR MANUFACTURE

[75] Inventors: Heinrich Brachert, Troisdorf-Oberlar; Dieter Girke, Troisdorf; Gerd Kellner, Aresing, all of Fed. Rep. of Germany

[73] Assignee: Dynamit Nobel Aktiengesellschaft, Fed. Rep. of Germany

[21] Appl. No.: 611,165

[22] Filed: Feb. 17, 1984

Related U.S. Application Data

[63] Continuation of Ser. No. 47,862, Jun. 13, 1979, abandoned, which is a continuation of Ser. No. 796,870, May 16, 1977, abandoned, which is a continuation of Ser. No. 685,393, May 10, 1976, abandoned.

[30] Foreign Application Priority Data

May 10, 1975 [DE] Fed. Rep. of Germany ..... 2520882
Aug. 5, 1975 [DE] Fed. Rep. of Germany ..... 2534898

[51] Int. Cl.[4] ..... C06B 45/00

[52] U.S. Cl. ..... 102/290; 102/289; 102/292

[58] Field of Search ..... 102/99, 100, 101, 102, 102/104, DIG. 1, 292, 289, 290; 60/253, 254

[56] References Cited

U.S. PATENT DOCUMENTS 540,327 6/1895 Maxim ..... 102/101

FOREIGN PATENT DOCUMENTS 1300941 6/1961 France .

*Primary Examiner*—Donald P. Walsh
*Attorney, Agent, or Firm*—Antonelli, Terry & Wands

[57] ABSTRACT

A single- or multiple-base powder charge for propellants is made up of at least one powder grain in the form of a shaped mass of powder having at least one internal cavity. The diameters of the internal cavities within the powder grains making up the charge are different and at least a portion thereof is smaller than the critical diameter that corresponds to the ignition pressure and that governs the penetration of the ignition flame into the internal cavities. With this arrangement at least a portion of the internal cavities is ignited with a retardation only by gas pressures that rise above the ignition pressure.

19 Claims, 10 Drawing Figures

SINGLE- OR MULTIPLE-BASE POWDER CHARGES FOR PROPELLANTS AND PROCESS FOR THEIR MANUFACTURE

This is a continuation application of Ser. No. 047,862, filed June 13, 1979, abandoned, which is a continuation of Ser. No. 796,870, filed May 16, 1977, which abandoned application is a continuation of parent application, Ser. No. 685,393, filed May 10, 1976, now abandoned.

The invention relates to single or multiple-base powder charges for propellants with at least one internal cavity and to a process for producing these powder charges.

It is known, for example from DOS [German Unexamined Laid-Open Patent Application] 2,059,571 and DOS 2,137,561, that in the use of launchers the muzzle velocity with an unchanged barrel length, mass of projectile, and maximum gas pressure, can be increased if parts of the charge are ignited and burn with a delay. This so-called internal-ballistic efficiency increase can be attained by means of a duplex or multiplex charge structure wherein the total charge consists of two or more partial charges which can be different with respect to geometry and composition. However, it has not been, as yet, possible to develop a system of this type for mass production. The reasons for this lack of development reside primarily in an inadequate safety and reproducibility of the ignition process of the second and optionally additional partial charges. The intentional delay in this ignition process has heretofore been provided by encapsulating the surfaces of the powder grains (i.e. which form the partial charges) or rendering these surfaces insensitive. However, internal ballistics require, for maintaining a specific maximum pressure tolerance, such an exact, reproducible activation of the second charge and optionally additional charges that this goal cannot be reached satisfactorily by means of the additional conventional mechanical or chemical agents for the intended ignition retardation.

It has furthermore been known from Steinhilpher, "Gasgeschwindigkeit und Druckaufbau in den Kanaelen von Roehrenpulvern" [Gas Velocity and Pressure Buildup in the Cavities of Tubular Grains], Explosivstoffe [Explosives] 1970, pp. 217–230, that a flame is propagated in fissures in all those cases where the fissure or gap width exceeds a certain "critical" value. If the fissure width is smaller than this critical value, then the flame front does not spread in the fissure. The initial temperature of the powder has an only minor effect on this critical gap width. The critical gap width slightly decreases with an increasing powder temperature. However, the pressure to which the combustion gases are exposed is of considerable influence, inasmuch as the critical gap width decreases superlinearly with increasing pressure. In the conventional tubular or perforated grains, the diameter of the internal cavity or cavities is above this critical gap width, so that the ignition gases penetrate fully into the internal cavities of the powder charges and effect a uniform ignition of the entire surface of the propellant.

The invention is based on the problem of attaining an increase in the efficiency of single and multiple-base powder charges for propellants of the type having at least one internal cavity by making use of the principle of a multiplex charge structure, but in contrast thereto employing an externally uniform charge composition.

This eliminates the necessity for an additional, external shielding of the individual parts of the charge for the purpose of ignition retardation.

The solution of this problem is accomplished according to this invention wherein the diameters of the internal cavities of the powder grains constituting one propellant charge are different and at least a portion thereof is smaller than the critical diameter pertaining to the ignition pressure and governing the penetration of the ignition flame into the internal cavities; and at least a portion of the internal cavities is ignited with a retardation only with gas pressures rising above the ignition pressure. The preferably multiple-base powder charges are fashioned, in particular, as powder granules or grains with one or more, for example 7 or 19, internal cavities so that the propellant charge as a whole is composed of many individual granules. If the powder charge is constructed, for example, as a cylindrical granule or grain with nineteen cavities and with an external diameter of 3.5 mm. and a height of 4.0 mm., then, with the customary powder density of 1.6 g./cm$^3$ and considering the nineteen internal cavities with an average diameter of about 130$\mu$, a piece number of about 18 per 1 g. of charge composition, or approximately 1350 granules, is the result; thus providing about 25,650 internal cavities for a propellant charge of 75 g. Basically, the powder grains of this invention can, however, also be produced with larger dimensions and can then be utilized individually as a propellant charge for caseless ammunition, for example. In this case, the powder charges have preferably considerably more internal cavities than, for example, nineteen. The powder charges of this invention are provided especially for smaller and medium calibers. However, they can also be used in case of larger calibers.

Conventional multiple-cavity powder grains possess internal cavities having approximately identical diameters, the size of which is above the critical value for the propagation of the flame front, so that a uniform burning of the powder grain is ensured. In contrast thereto, in the powder grains forming the charges of this invention, the diameters of the internal cavities are, on the one hand, different and, on the other hand, are at least in part below the critical value. Therefore, upon the ignition of the propellant charge, the external surfaces of the powder grains as well as only those internal cavities where the diameter is larger than the critical value, based on the ignition pressure which generally ranges between about 50 to 200 bars, will be ignited. The critical diameter amounts to about 100–200$\mu$. This diameter is the smaller, the higher the gas pressure of the system due to the ignition step. The internal cavities where the diameter is smaller than the critical value do not burn as yet, but rather are ignited only when, due to the rise of the system gas pressure, a pressure value has been reached fulfilling the ignition condition. Since the internal diameters of these internal cavities, which are not immediately fired by the ignition, are different from one another, their ignition condition is reached at different system gas pressures. Consequently, the internal cavities are ignited individually or in groups in sequence and thus are ignited in the desired manner with retardation. From the viewpoint of internal ballistics, each such ignition represents a sudden increase in the burning surface area and thus quasi the addition introduction of an individual partial charge. The "system gas pressure" is understood to mean, in this connection, the total gas pressure ambient in the propellant chamber, which is equal to the ignition pressure and/or the sum total of ignition pressure and the pressure caused by the burning of the grain.

The ignition retardation according to this invention and the ensuring advantageous flattening of the pressure curve in dependence on the time are dependent on the distribution of the internal cavity diameters of the powder grains forming a propellant charge structure. This distribution, i.e. the number of internal cavities pertaining to the individual diameter values, is, in turn, linked to the corresponding parameters of the ammunition and the firearm system. Such parameters are, for example, the ignition, the powder chamber, the projectile base path, and the maximally permissible firearm utility pressure. Thus, the distribution function must be shifted toward smaller diameter values if a more vigorous ignition is employed, i.e. one with a higher ignition pressure or with a more quickly rising ignition pressure. If the available maximum charge chamber is filled with propellant powder, but the maximally permissible gas pressure is not attained due to an excessive ignition retardation of part of the internal cavities, then—unless a pressure increase is still possible by increasing the extraction resistance or the like—the distribution function must be shifted toward larger diameter values and thus the ignition retardation must be reduced. The longer the path to be traversed in the firearm by the base of the projectile, the slower can be the burnout of the propellant charge, so that the ignition delay can be increased on the basis of this effect, i.e. the distribution function can be shifted toward smaller diameter values. An increase in the maximally permissible weapon utility pressure has an analogous effect.

In an advantageous development of the invention, the distribution function of the diameter values of the internal cavities is fixed so that the predominant portion of the internal cavity diameters is present in a predominant distribution of between about 10 to 250μ and preferably from about 50 to 150μ. The limits of the distribution function selected in an individual case are, for the minimum internal cavity diameter, at the value which, upon exit of the projectile from the barrel, yields just exactly the burnout effect. With respect to this principle involved, there are no restrictions for the maximum internal diameter, but one must take into account that the influence of the actually reached ignition delay and thus the attained increase in efficiency become the smaller, the larger the maximum diameter values and the higher the number thereof. Internal cavities having a diameter larger than 250μ can, however, be definitely advantageous in a particular case, for example in order to enlarge the immediately ignited powder surface area. However, these few large internal cavities must then be distributed over the powder grains forming a propellant charge so that reproducible relationships are ensured. The distribution function can be, depending on the requirements, similar to a section from a parabola, a sine curve, a Gaussian distribution, or the like. Optionally, this curve can also have two or more maxima. Also a linear curve in parallel to the abscissa is possible, for example in case of single-hole grains, by mixing powder grains having a correspondingly different internal cavity diameter.

The percentage-wise change of the initial burning surface area due to the above-indicated effects can reach considerable values, depending on the distribution function. As compared to a conventional propellant charge powder with a uniform ignition, an increase in efficiency is thereby obtained in an advantageous manner.

The invention is illustrated in the accompanying drawings, wherein.

Figure 8:
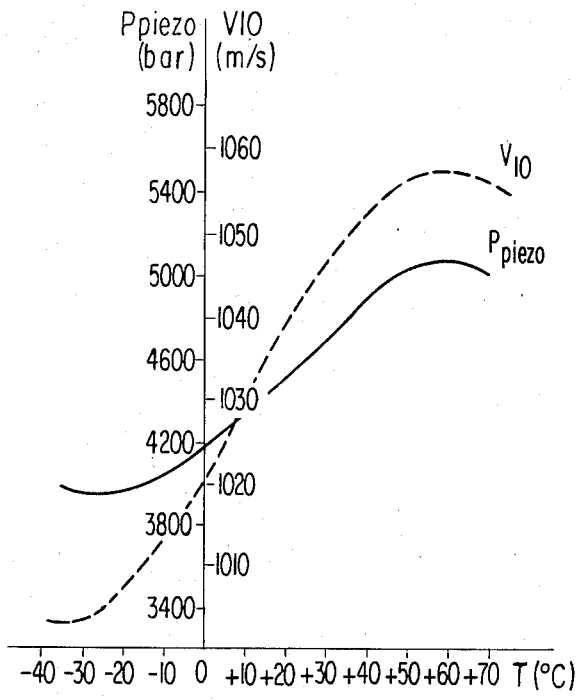
Figure 10:
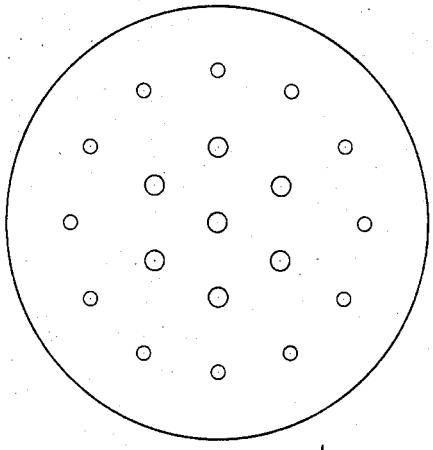
Figure 9:
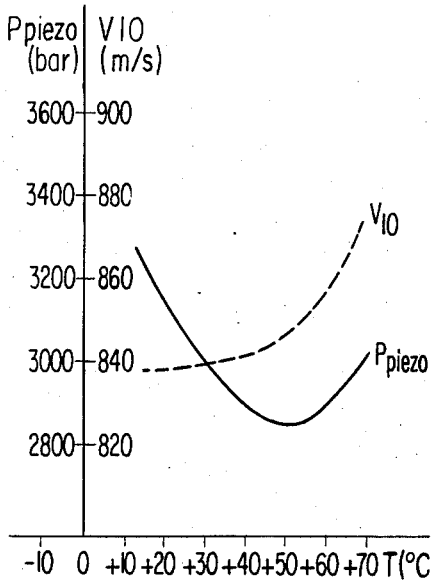

FIG. 8 further illustrates the ballistic firing results of a propellant charge of this invention;

FIG. 9 shows additional ballistic firing results of yet another propellant charge; and FIG. 10 is an illustration of a top view of a nineteen-hole grain showing a possible arrangement of the internal cavities therein.

Figure 1:
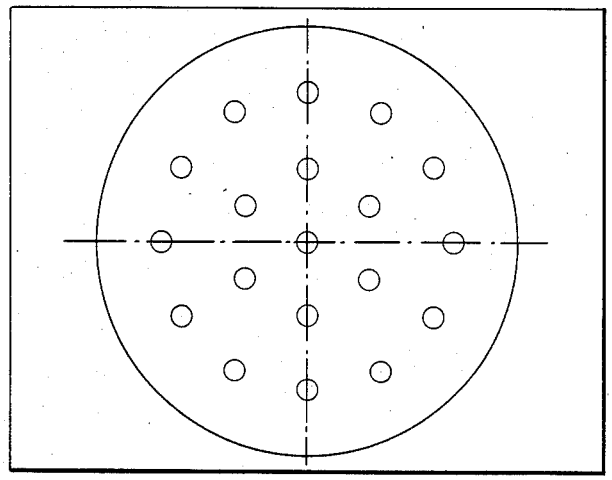
FIG. 1 is an illustration of a photograph in about 20-fold enlargement of a powder grain of a propellant charge before ignition.
Figure 2:
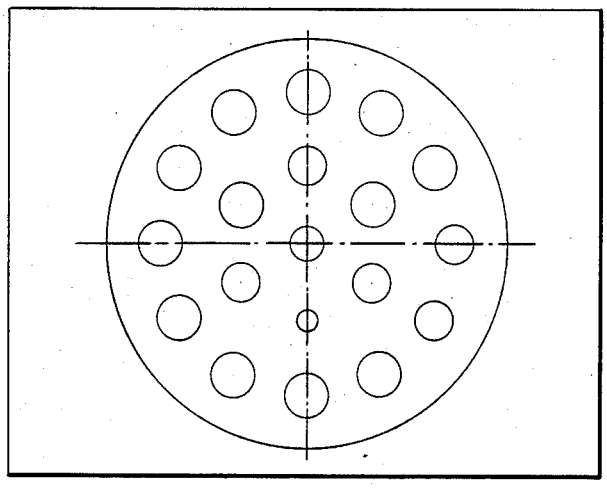
FIGS. 2, 3 and 4 are illustrations of photographs of three grains of the same propellant charge, wherein burning has been interrupted after about 30% of the charge has been combusted.
Figure 3:
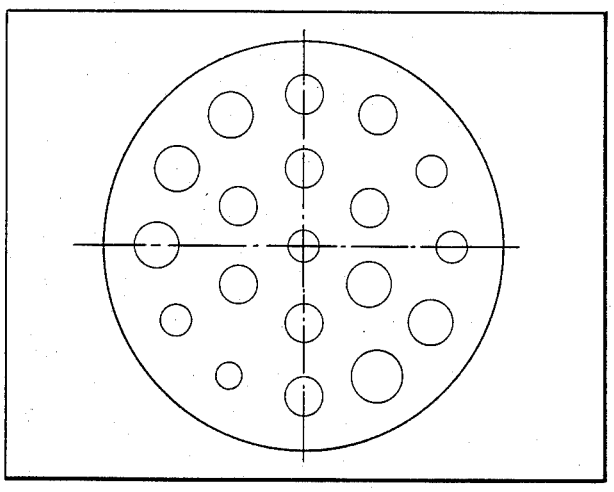
Figure 4:
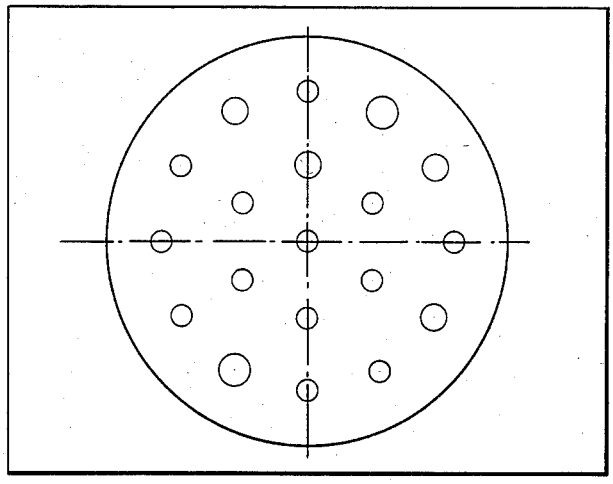

The ignition retardation according to this invention with respect to the internal cavities can clearly be seen in FIGS. 1–4, representing illustrations of photographs taken on the same scale. In FIG. 1, wherein reference numeral 1 designates an edge of photograph the initial grain 2 of powder so-called "green grain". All the internal cavities or holes 3 do not show the same diameter but differ in diameter more or less considerably from one another, although this cannot be fully illustrated in the Figure due to the extent of enlargement and although the deviation of the diamater of the internal cavities will range from a few to several microns. This grain is a cylindrical nineteen-hole element with an external diameter of 3.5 mm., a section length of 4.0 mm., and an average diameter of the internal cavities of about 124μ. FIGS. 2–4, which can be compared directly with FIG. 1 and with one another due to the same scale of photography, show powder grains wherein the burning has been interrupted after about 30% of the propellant powder mass has been combusted. The interruption was effected by bursting the burning bomb, the powder grains being simultaneously driven into a water receiver. All three partially burnt powder grains stem from the same experimental propellant charge. FIG. 2 shows a powder grain wherein all internal cavities have already burned, except for an internal cavity located in the lower half of the figure. The fact that this cavity cannot as yet have participated in the burning is shown very clearly by comparing the size with FIG. 1.

According to FIG. 2, powder grain 2' is burned up, in part, both from the outside; i.e., from its outside surface 4', as well as from the internal cavities 3' as can be seen on one hand from the essentially larger interval a' between the edge 1' of the photograph and outside surface 4' with respect to the interval a between edge 1 and the outside surface 4 in FIG. 1; on the other hand, from a comparison between the internal cavities 3' of FIG. 2 with the internal cavities 3 of FIG. 1. At the same time, the internal cavities 3' have diameters that differ from one another in that the cavities have begun to burn sequentially at quite different times or the internal cavities designated by reference numeral 3' have not yet clearly burned up as the case may be when the test grain was extinguished in a water collector.

FIG. 3 shows a powder grain which has commenced burning with a relatively uniform rate; whereas FIG. 4 shows a powder grain which has just started to burn from the inside toward the outside.

In the test grain 2' of FIG. 3, the grain is burned up from its circumference in the same manner as the grain shown in FIG. 2, although the internal cavities 3'' exhibit other burning diameters as compared to those of FIG. 2. In the test grain 2''' of FIG. 4, at the time of extinguishing of the powder charge in the water collector, the innermost internal cavities 3''' have still not yet begun to burn although powder grain 2''' has also burned from a circumference 4''' in a manner similar to powder grains 2' and 2'' of FIGS. 2 and 3.

In case of a propellant charge having a mass of, for example, 75 g., the extreme differences as illustrated in FIGS. 3 and 4 are distributed statistically due to the very large number of granules or grains forming the charge, so that the scattering of the ballistic values attained with such a charge structure lies within the normally permissible range. It can be seen from the above that the distribution function of the internal cavities in the so-called "green grain" is of considerable influence for optimizing the efficiency and adaptation of the propellant powder to the parameters of the weapon. In this connection, the primary factors are the parameters of ignition, maximum charge mass, maximum gas pressure, as well as the path traversed by the base of the projectile.

The propellant charge powder of FIGS. 1-4 had the following composition:

72.2% by weight of nitrocellulose with 13.17% by weight of nitrogen content, 21.7% by weight of diethylene glycol dinitrate, 4.6% by weight of nitroguanidine, 0.8% by weight of methyldiphenylurea ("A kardit II"), 9.7% by weight of potassium sulfate.

The production of the propellant powder takes place as customary for solvent powders. The nitrocellulose is used in an alcohol-moist form. Nitrocellulose, nitroguanidine, methylphenylurea, and potassium sulfate are first mixed in the dry state in a masticator for about 10 minutes. Then the solvent is added, for example acetone. The quantity is dependent on the alcohol content of the nitrocellulose and on the desired consistency of the masticated material and is in most cases about 20% by weight. After adding the acetone, the mixing and/or masticating step is continued for another 20 minutes. Only at this point in time is the diethylene glycol dinitrate added, which is present as a powder preconcentrate. Subsequently, the mastication is continued for another 3½ hours at about 30° C. After the masticating step is finished, the material is subjected under a seal to an aging storage step of at least 3 days. Prior to the further processing, for example in a potting press or extruder, the masticated material is once again masticated for ½ hour to ensure homogenity. The molding step is preferably carried out at room temperature in an extruder. Immediately after termination of a molding step, the rod-shaped extrudates are cut in a round cutting machine.

The thus-obtained granulated powder material in the form of rod-shaped grains is treated directly after the cutting step with about 0.03% by weight of graphite to increase the conductivity of the still moist granulated powder and to extensively avoid the sticking together of the individual powder grains during the subsequent drying step. The powder grains are dried preferably in two phases. In case of drying the granulated material in a chamber, the material is stored in canvas bags for 1-3 days at room temperature. During this procedure, a large portion of the solvent is already volatilized. The remainder of the solvent is removed during the drying step proper, preferably by conducting air at a temperature of 30°-60° C. through the powder. The duration of this process is 1-5 days. To free the propellant powder from oversized or undersized components, the powder is subsequently sorted by screening.

The distribution of the diameters of the internal cavities of this propellant powder was determined with the aid of 10 powder grains selected arbitrarily. The measurements of the individual internal cavity diameters resulted in the following distribution, wherein the values were combined in ranges of respectively 10μ:

| Diameter in μ | Number |
|---|---|
| 50 | 1 |
| 60 | 1 |
| 70 | 5 |
| 80 | 4 |
| 90 | 8 |
| 100 | 16 |
| 110 | 22 |
| 120 | 29 |
| 130 | 48 |
| 140 | 35 |
| 150 | 9 |
| 160 | 6 |
| 170 | 4 |
| 180 | 2 |

As the average diameter, a value of about 124μ is derived from the above.

It is known that conventional ammunition generally has a positive temperature gradient, i.e. with an increasing ammunition temperature, the maximum pressure and, to a limited degree, the muzzle velocity are increased. The maximally permissible highest pressure in the corresponding firearm system is consequently reached at the highest permissible temperature. Such a progressive temperature characteristic is disadvantageous. Rather, the desirable feature would be to fashion the propellant charge powder so that the corresponding ammunition, if possible in the range of its primary utility temperature, has a more extensively temperature-independent characteristic. In such a case, the maximum gas pressure is not reached at the highest permissible temperature, but rather at a lower temperature. Since this propellant charge powder then has a plateau-like behavior as compared to the conventional powder due to the smaller positive or negative temperature gradient, the pressure and velocity thus vary, starting with the aforementioned maximum value with a rising or falling temperature—at least in a certain range—less greatly than in the conventional powder. In this manner, a constant-degressive temperature spectrum characteristic is obtained whereby the maximum efficiency range of the firearm or weapon is expanded over a larger temperature range. Insofar as this plateau zone and/or plateau-like range covers the primary usage range of a firearm, for example +15° C. to +60° C., the otherwise customary temperature effect on the sighting device and the target action is eliminated and/or reduced. In this connection, it is then also possible to determine, for the design pressure of the ammunition at normal temperature, the permissible maximum pressure or, after all, at least almost this maximum pressure of the weapon system.

At normal temperature, an increase in the efficiency is attained in this way, which can be very considerable, depending on the temperature gradient of the conventional ammunition. In a numerical example, this fact will be explained in somewhat greater detail:

A weapon with a barrel is assumed to be limited by a maximally feasible pressure p of 4000 bars. The prescribed temperature spectrum is assumed to extend from −30° C. to +60° C. The conventional ammunition has normally a temperature gradient for the velocity of 1 m./sec. per degree. A velocity change of 10 m./sec. is associated, in case of this weapon, with a pressure change of 200 bars. The maximum pressure is just reached at +60° C., and the thus-attained muzzle velocity $v_o$ amounts to 1000 m./sec. According to the above assumptions, the values for $v_o$=955 m./sec. and p=3100 bars result at +15° C. An ammunition with a propellant charge powder having a plateau characteristic in the primary use range of, for example +15° C. to +60° C. would, however, reach in this range the maximum values, i.e. $v_o$=1000 m./sec. and p=4000 bars, or would at least reach those values almost.

To attain this objective, French Pat. No. 1,300,941 describes a process for the production of propellant charge of cavity-containing grains having a minor temperature gradient, according to which the powder grains are subjected to a differentiated aftertreatment. During this aftertreatment, the powder grains are impregnated with the treatment agent, for example symmetrical diethyldiphenylurea ("Centralite I") so that a staggered distribution of the treatment agent on the external grain surfaces is obtained as compared to the internal surface area of the cavities. To avoid or restrict the penetration of the treatment agent into the internal cavities of the powder grains, the differential aftertreatment can be controlled by the selection of the internal cavity diameters, by the viscosity and temperature of the treatment agent, as well as by the temperature and duration of the impregnating step.

This conventional process, however, represents an unsatisfactory solution under practical conditions, inasmuch as a relatively large amount of the treatment medium must be expended to attain the desired goal, in case of "Centralite I," for example, 2–5% by weight. These treatment agents have a negative enthalpy of formation and reduce the total energy of the charge composition mass present in a propellant charge chamber. Moreover, powders which have undergone such a vigorous surface treatment are more difficult to ignite, and this is disadvantageous with respect to the total firing time. Therefore, it is desirable to keep the proportion of such treatment agents as small as possible. Additionally, the differentiated aftertreatment is very time-consuming and undesirably increases the expenditures required for the powder manufacture.

To avoid these disadvantages, an advantageous further development of the invention provides, for powder grains having the aforementioned favorable temperature characteristic, powder charges wherein, with an increasing temperature, the deformability of the powder becomes easier and thereby a portion of the internal cavities becomes increasingly compressible under the effect of the gas pressure; and that these compressed internal cavities are ignitable only upon still further increased gas pressures, in order to reduce or compensate for and/or overcompensate for the effect of the linear burning rate of the powder, which rate increases with a rising temperature. In this way, a dynamic pressure deformation of the not yet ignited internal cavities occurs, i.e. these internal cavities are squeezed together, so that their inside cross section is still further reduced and thus their ignition is additionally retarded. The pressure deformation is essentially dependent on the geometry of the powder charges, i.e. the size and arrangement of the internal cavities in the powder charge, the plasto-elastic behavior, and the system gas pressure effective on the powder charges, be it in the form of the ignition pressure or as the sum total of ignition pressure and the pressure due to the burning of the propellant powder. In this connection, a not yet ignited internal cavity is subjected to a pressure force not only from the outer surface of the powder charge, but also from already ignited adjacent internal cavities wherein, for example, a pressure of 1000 bars is already ambient, whereas in the not yet ignited internal cavity there is an essentially lower pressure. The plasto-elastic behavior of the powder charges is dependent on the temperature; the deformability increasing with a rising temperature, at least in a certain range. In general, the change in the deformability at higher temperatures is very much greater than in case of lower temperatures, so that the dynamic pressure deformation of this invention in connection with the not yet ignited internal cavities has an increased effect at higher temperatures. The system gas pressure must rise sufficiently rapidly in this case, i.e. a corresponding vigorous ignition must be provided, for example, in order to reduce the size of the internal cavities before the ignition flame can penetrate into these cavities. A pressure gradient of about 0.5 to $10^6$ to $10^8$ bars/sec. proved to be advantageous in case of the ignition of medium-caliber ammunition. However, a less vigorous ignition can be provided if the powder, in turn, burns correspondingly rapidly so that the system gas pressure rises quickly enough.

Thus, according to this invention, due to the blocking function of part of the internal cavities, pressure differences are encountered in the powder charges which, in conjunction with the temperature-dependent plasto-elastic behavior, lead to a temperature-dependent deformation of the powder charges, whereby the inside diameters of the not yet ignited internal cavities governing for the ignition process are reduced in size. The additional introduction of burning areas, retarded in this way in dependence on the temperature, reduces and/or compensates for or even overcompensates for the increased energy supply due to an increase in the burning rate of the powder charge at an increase in the temperature. Conversely, with a dropping temperature, the quasi-additional burning surface areas are added at an earlier point in time, which counteracts the effect of the linear burning rate which in this case is on the decrease. These effects are especially great where the strength characteristics of the propellant powder change to a very great extent, i.e. at very low and very high temperatures. The plasto-elastic behavior of the powder charges in the temperature range from −40° C. to +70° C. is connected with a change in the modulus of elasticity of between about 30,000 and 250 kp./cm$^2$.

According to another embodiment of this invention wherein there are provided several annularly arranged internal cavities as seen starting from the outer surface of the powder grains—alternatingly internal cavities with a smaller and with a larger diameter are arranged in succession. In this manner, the internal cavities are preferably arranged so that a maximum number of them are subject to the dynamic deformation. In case of a nineteen-hole grain, the 12 internal cavities disposed toward the outside thus will have a smaller diameter than the six internal cavities arranged on the inside, whereas in case of a 43-hole grain, the outer ring with 24 internal cavities and the innermost ring with six internal cavities will preferably have a smaller internal cavity diameter than the central ring with 12 internal cavities. This has the advantageous result that the internal cavities of the inner and/or intermediate ring are ignited with preference, whereby the not yet ignited internal cavities of the outer ring, for example, will then be subject, in addition to the pressure from the outer surface of the powder charges, also to the pressure emanating from the inside.

The powder charges of this invention can be produced, for instance, by use of the solvent method and are subjected to different degrees of shrinkage, wherein the change in the shrinkage of the single- or multiple-hole powder grains produced by the conventional solvent method yields the desired differing internal cavity diameters of the grains. The required statistical distribution of the diameters of the internal cavities per charge is then ensured by mixing the finished grains to form charges of at least about 500 kg. The degree of shrinkage can be affected, for example, by the solvent proportion, the ratio of the various solvents with respect to one another, the temperature, and the duration of the shrinking process. The shrinking effect is the stronger, the greater the quantity of solvent employed. Preferred solvents are mixtures of ethyl alcohol and ether or also acetone. The amount of the solvent is generally between about 10 and 40% by weight. Ether or acetone act as solvents in the real sense of this term; the proportion of these solvents in the solvent mixture must not fall below a minimum value of about 10% by weight, based on the solvent mixture, so that a sufficient gelatinization of the powder composition is still attained. The maximum value is about 70% by weight. Ether or acetone is added to obtain a swelling and initial gelatinization of the nitrocellulose. The shrinkage temperature and duration are between about 30° and 60° C. and about 24–120 hours, respectively. An increase in the shrinking temperature effects an increasing keratinization of the powder charge surface and thereby effects a reduction in the solvent evaporation and shrinkage.

A further possibility for the manufacture of the powder charges according to this invention with differing internal cavity diameters is effected by a process wherein during the piston-type extrusion or screw-type extrusion or the like of the powder grains, spikes of different thicknesses are utilized for the formation of the internal cavities. This process is suitable, in particular, for the production of powders without solvents, but it can also be applied to the solvent method, optionally in conjunction with an intended, differentiated shrinkage. The differently thick spikes or needles can then be arranged on the spike plates of the molding matrices in a distribution corresponding to the respective requirements. In principle, however, the internal cavities can also be formed subsequently in the powder charges, for example by pulling out wires of a corresponding diameter, embedded in the powder charges, after the molding step has been completed. Optionally, the provision can also be made to fashion the internal cavities subsequently with the aid of laser beams in the powder grains. According to the process wherein the cavities are formed subsequently, the tolerance for the internal cavity diameters can be narrowed, and thus only a relatively low number or even merely a single one of such powder grains is needed to make the efficiency values reproducible without appreciable fluctuations. A field of use for such powder charges is, for example, caseless ammunition.

The powder charges of this invention can, optionally be furthermore altered subsequently by a surface treatment with plasticizers, preferably phthalates or camphor, with respect to their strength properties, and can thus be optimally adapted to the respective weapon and ammunition parameters. The process makes it possible to effect a subsequent, additional change in the shape of the temperature spectrum characteristic along the lines that, with an increasing vigor of the treatment, the maximum of the gas pressure curves and/or velocity curves is shifted toward lower temperatures. With a satisfactory adjustment of the distribution function for the internal cavity diameters, the amount of the surface treatment agent to be introduced into the powder subsequently is minor and only rarely exceeds the value of 1% by weight.

Figure 5:
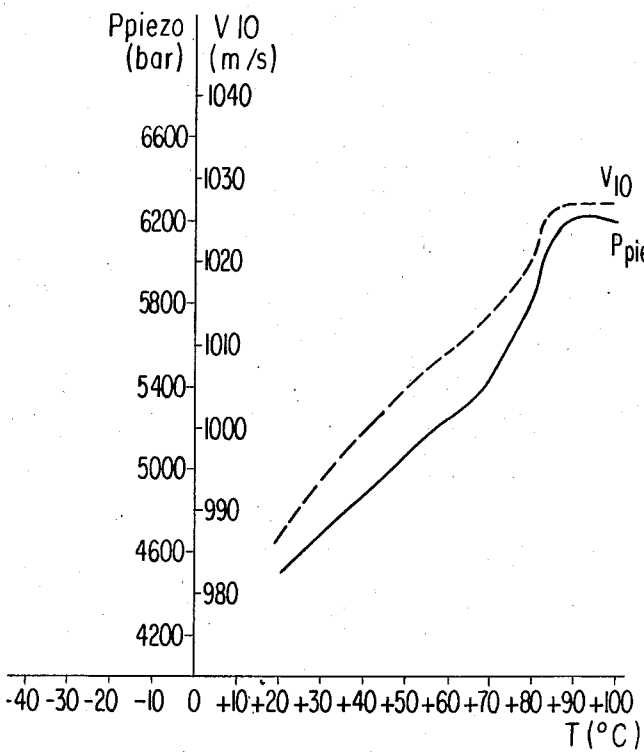
FIGS. 5 and 6 illustrate the relationship between the gas pressure in the cartridge chamber and the velocity of the projectile in the muzzle as a function of temperature.

The following examples indicate several ballistic results demonstrating the advantageous behavior of the powder charges according to this invention. FIG. 5 shows the pressure $p_{piezo}$ in bars and the velocity $v_{10}$ in m./sec. as a function of the temperature T in °C. The pressure $p_{piezo}$ was measured by means of a piezoelectric element in the tube of a gas pressure measuring pipe, namely in the cartridge chamber, whereas the velocity $v_{10}$ of the projectile was measured 10 meters in front of the muzzle. The propellant charge consisted of 75 g. of a triple-base powder corresponding to that shown in FIGS. 1–4 and heretofore described. It can clearly be seen that this powder without any surface treatment, i.e. the green grain, has a plateau and/or degressive character. The ignition pressure was about 80–100 bars.

This green grain powder was then surface-treated. The surface treatment takes place preferably in a heatable vertically disposed drum. The powder grains are heated with 50% by weight of *lignum vitae* balls to 50° C. The, 1% by weight of alcohol is introduced by spraying, and the drum is allowed to run in the sealed condition for 30 minutes. Thereafter, 1% by weight of the treatment agent, di-(2-ethylhexyl)-phthalate, is added in incremental portions in the form of a 10% strength alcoholic solution. Thirty minutes after the last addition of treatment agent, 0.1% by weight of graphite is added for polishing purposes. Thereafter, the drum is operated for another 30 minutes in the sealed state and thereafter opened until the primary amount of alcohol has escaped. The residual alcohol is driven out by warm air within 8–24 hours, as described above.

Figure 6:
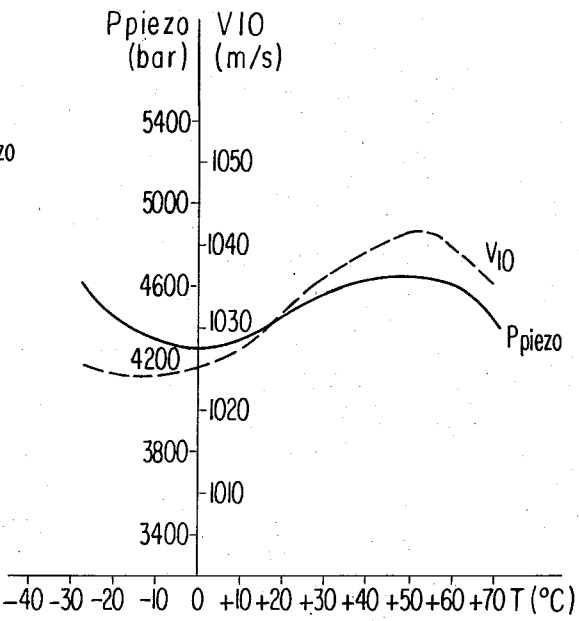

The ballistic firing results for this powder are indicated in FIG. 6. The plateau and/or degressive behavior has been markedly enhanced, although the amount of treatment agent incorporated therein is comparatively very small. The ignition pressure was about 80–100 bars.

Figure 7:
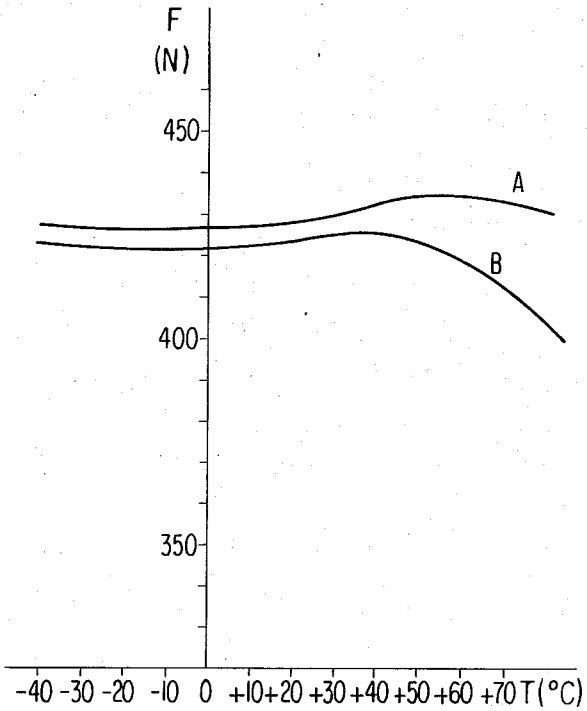
FIG. 7 is a graph illustrating the relationship between the shearing force of the powder charge as a function of the temperature.

FIG. 7 shows the shearing force F of the aforementioned powder charges, measured in N, as a function of the temperature T. The shearing mechanism had two shear blades provided with a continuous transverse bore for receiving the tempered powder grain and being disposed in side-by-side relationship. The two shear blades were displaced with respect to each other by means of a drawing mechanism, by means of which the shearing force could be applied within the millisecond range, rather than statically, namely 7.8 N/ms. The force F during the shearing of the powder grain was measured by means of an oscillograph. The results were the curves A for the green grain and B for the surface-treated powder. At the high temperatures, a strong reduction in the shearing force F can be observed. At temperatures of below −60° C., a brittleness effect is to be expected, connected with a corresponding rise in F. The thermal expansion of this powder is about $2 \cdot 10^{-4}$/°C.

FIG. 8 shows the ballistic firing results of a propellent charge made up of 84 g. of a nineteen-cavity grain with a 3.5 mm. outer diameter, a 5.8 mm. section length, and an average diameter of the internal cavities of about 120μ. Here again, the desired degressive or plateau characteristic can be clearly observed. The ignition pressure was about 80–100 bars.

The powder had the following composition:

66.1% by weight of nitrocellulose with 13.17% by weight of nitrogen content, 22.7% by weight of diethylene glycol dinitrate, 9.6% by weight of cyclotrimethylenetrinitramine (hexogen), 0.5% by weight of "Akardit II,"

1.1% by weight of potassium sulfate.

The production of this powder and the surface treatment thereof took place analogously to those of the nitroguanidine powder explained hereinabove.

The measurements of the individual internal cavity diameters on ten powder grains which were arbitrarily selected yielded the following distribution, wherein the values were again combined into ranges of respectively 10μ:

| Diameter in μ | Number |
|---|---|
| 50 | 1 |
| 60 | 1 |
| 70 | 3 |
| 80 | 6 |
| 90 | 10 |
| 100 | 18 |
| 110 | 20 |
| 120 | 28 |
| 130 | 50 |
| 140 | 34 |
| 150 | 10 |
| 160 | 5 |
| 170 | 3 |
| 180 | 1 |

Average diameter about 120 μ.

An additional example is a single-base nineteen-hole powder wherein the grains have an outer diameter of 3.5 mm., a section length of 4.0 mm., and an average hole diameter of about 122μ. The ballistic firing results of a propellant charge made up of 80 g. of this powder are indicated in FIG. 9. The velocity curve is progressive in the range under consideration, but the pressure curve is clearly degressive in an advantageous manner. The ignition pressure was about 100 bars.

The powder had the following composition:

96.2% by weight of nitrocellulose with 13.17% by weight of nitrogen content, 1.9% by weight of "Akardit II°"

0.9% by weight of diphenylamine, 1.0% by weight of potassium sulfate.

The production method used corresponds extensively to that of the aforedescribed nitroguanidine powder, except that the diphenylamine is added while dissolved in the solvent for a more uniform distribution effect, i.e. the compound is not added with the starting materials, but together with the solvent. The powder was not surface-treated for desensitizing, but was rather merely polished with 0.1% by weight of graphite—as indicated above—to be able to accommodate a greater amount of propellant charge powder in the cartridge case due to a thus-increased bulk density. This graphitization has practically no effect on the internal ballistics, so that this powder must be equated to a green grain.

The measurements of the individual internal cavity diameters on ten powder grains arbitrarily selected resulted in the following distribution, wherein again the values were combined into ranges of respectively 10μ:

| Diameter in μ | Number |
|---|---|
| 50 | 1 |
| 60 | 1 |
| 70 | 5 |
| 80 | 7 |
| 90 | 8 |
| 100 | 17 |
| 110 | 21 |
| 120 | 30 |
| 130 | 46 |
| 140 | 36 |
| 150 | 9 |
| 160 | 5 |
| 170 | 3 |
| 180 | 1 |

Average internal cavity diameter approximately 122 μ.

FIG. 10, finally, shows a top view of a nineteen-hole grain wherein the central internal cavity and the six internal cavities of the inside ring have a larger diameter than the twelve internal cavities of the outside ring. For reasons of drawing technique, the two groups of internal cavities are each shown with an identical average cavity diameter. However, in reality, the diameters of the internal cavities differ, so that the powder grains relate to a charge structure have the distribution of the internal cavity diameters of this invention.

What is claimed is:

1. A single- or multiple-base powder charge for propellants having at least one internal cavity formed therethrough, which comprises at least one powder grain in the form of a shaped mass of powder, the diameters of the internal cavities of the powder grains constituting said propellant charge being different and at least a portion thereof being smaller than the critical diameter pertaining to the ignition pressure and governing the penetration of the ignition flame into the internal cavities; and at least a portion of the internal cavities being ignited with a retardation only with gas pressures rising above the ignition pressure; at least the predominant portion of the internal cavities having diameters that are present in a predetermined distribution of from about 10 to 250μ.

2. A powder charge according to claim 1, wherein at least the predominant portion of the internal cavities have diameters that are present in a predetermined distribution of from about 50 to 150μ.

3. A powder charge according to claim 1, wherein with an increasing temperature, the deformability of the powder becomes easier and thereby a portion of the internal cavities becomes increasingly compressible under the effect of the gas pressure; and these compressed internal cavities are ignitable only upon still further increased gas pressures, in order to reduce or compensate for and/or overcompensate for the effect of the linear burning rate of the powder, which rate increases with a rising temperature.

4. A powder charge according to claim 1, said at least one grain having several internal cavities arranged in annular rows with alternating internal cavities with a smaller and with a larger diameter being arranged in succession from the outer surface of the grain.

5. A process for the production of a powder charge according to claim 1, characterized in that the powder charge is produced by the solvent method and is subjected to different degrees of shrinkage.

6. A process for the production of powder charge according to claim 4, characterized in that, during the piston-type extrusion or screw-type extrusion or the like of the powder grains, spikes of different thicknesses are utilized for the formation of the internal cavities.

7. A process for the production of a powder charge according to claim 4, characterized in that the internal cavities are formed subsequently in the molded powder charge.

8. A process for the production of a powder charge according to claim 4, characterized in that the powder grains are surface-treated at least once with at least one plasticizer for said powder grains.

9. A powder charge for propellants that exhibit ignition retardation due to the presence of a plurality of internal cavities of differnt diameters which comprises a plurality of powder grains, each powder grain being in the form of a shaped mass of powder having a uniform charge composition and having a plurality of internal cavities formed therethrough, the diameters of the internal cavities of each powder grain constituting said propellant charge being different and being microscopic in size; at least a portion of the internal cavities being smaller than the critical diameter pertaining to the ignition pressure and governing the penetration of the ignition flame into the internal cavities of said powder grain, said at least a portion of the internal cavities being ignited with a retardation only by gas pressure generated during burning that rise above the ignition; the critical diameter being from about 100 to 200$\mu$ and the ignition pressure ranging between 50 and 200 bars.

10. A powder charge according to claim 9, wherein at least the predominant portion of the internal cavities have diameters that are present in a predetermined distribution of from 10 to 250$\mu$.

11. A powder charge according to claim 9, wherein at least the predominant portion of the internal cavities have diameters that are present in a predetermined distribution of from about 50 to 150$\mu$.

12. A powder charge according to claim 9, wherein with an increase in temperature, the formability of the powder grain becomes easier and thereby a portion of the internal cavities becomes increasingly compressible under the effect of the gas pressure and these compressed cavities are ignitable only upon still further increased gas pressures in order to reduce or compensate for and/or overcompensate for the effect of the linear burning rate of the powder, which rate increases with a rising temperature.

13. A powder charge according to claim 9, wherein each powder grain comprises a molded mass of powder having several internal cavities arranged in annular rows with alternating internal cavities having a smaller and a larger diameter being arranged in succession from the outer surface of the grain.

14. A process for the production of a powder charge according to claim 9, wherein the powder charge is produced by the solvent method and is subjected to different degrees of shrinkage in order to form the internal cavities therein.

15. A process for the production of a powder charge according to claim 13, wherein the molded mass of powder is obtained by extrusion and during extrusion, spikes of different thicknesses are arranged within the extrusion apparatus to effect formation of the internal cavities.

16. A process for the production of a powder charge according to claim 13, wherein the internal cavities are formed subsequently to the initial formation of the molded mass of powder.

17. A process for the production of a powder charge according to claim 13, wherein the powder grains are surface-treated at least once with at least one plasticizer for said powder grains.

18. A powder charge according to claim 9, wherein said powder charge is formed of an externally-uniform charge composition and said powder charge is free of external mechanical and chemical means for effecting ignition retardation.

19. A single- or multiple-base powder charge for propellants having at least one internal cavity formed therethrough, which comprises at least one powder grain in the form of a shaped mass of powder, the diameters of the internal cavities of the powder grains constituting said propellant charge being different and at least a portion thereof being smaller than the critical diameter pertaining to the ignition pressure and governing the penetration of the ignition flame into the internal cavities; and at least a portion of the internal cavities being ignited with a retardation only with gas pressures rising above the ignition pressure; the critical diameter being about 100 to 200$\mu$ and the ignition pressure ranging between 50 and 200 bars; and at least the predominant portion of the internal cavities having diameters that are present in a predetermined distribution of from 10 to 250$\mu$.

* * * * *